US009788618B2

(12) United States Patent
Christy

(10) Patent No.: US 9,788,618 B2
(45) Date of Patent: Oct. 17, 2017

(54) COMPRESSION CARD HOLDER

(71) Applicant: Matthew R. Christy, Raleigh, NC (US)

(72) Inventor: Matthew R. Christy, Raleigh, NC (US)

( * ) Notice: Subject to any disclaimer, the term of this patent is extended or adjusted under 35 U.S.C. 154(b) by 65 days.

(21) Appl. No.: 14/724,860

(22) Filed: May 29, 2015

(65) Prior Publication Data

US 2015/0342314 A1 Dec. 3, 2015

Related U.S. Application Data

(60) Provisional application No. 62/004,656, filed on May 29, 2014.

(51) Int. Cl.
*A45C 11/18* (2006.01)
*A45C 1/06* (2006.01)

(52) U.S. Cl.
CPC ..... *A45C 1/06* (2013.01); *A45C 11/182* (2013.01); *A45C 2001/065* (2013.01); *A45C 2001/067* (2013.01)

(58) Field of Classification Search
CPC ..... A45C 1/06; A45C 2001/065; A45C 2001/067; A45C 11/182
USPC ..... 206/9–39.8, 37–37.8, 38–38.1, 449, 555, 206/556; 150/148, 147, 132
See application file for complete search history.

(56) References Cited

U.S. PATENT DOCUMENTS 5,358,019 A 10/1994 Sumner, III
5,944,080 A 8/1999 Podwika
6,412,627 B1 7/2002 Tiscione et al.

*Primary Examiner* — Anthony Stashick
*Assistant Examiner* — James M Van Buskirk
(74) *Attorney, Agent, or Firm* — M. Robert Christy

(57) ABSTRACT

Disclosed is a card and money holder for simultaneously holding paper money and wallet sized cards, such as those containing credit or identification information. Said card and money holder comprises a generally rectangular prism shaped card and money holder, and a compression plate inside the rectangular shaped card and money holder. The card and money holder may hold one or a plurality of cards with said cards being held securely in place. The design allows for a unique rotation method of inserting cards into the card and money holder while card removal can be achieved one handed by sliding a card through the retrieval slot.

10 Claims, 7 Drawing Sheets

FIG. 5A
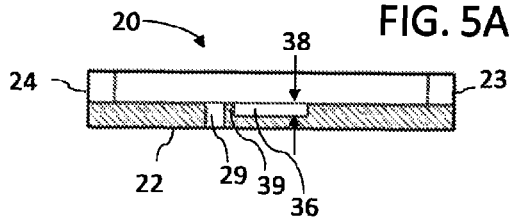
FIG. 5B
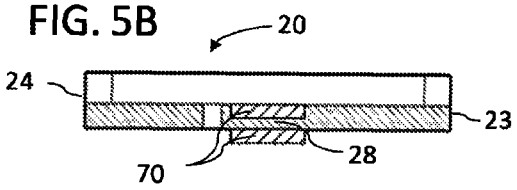
FIG. 6A
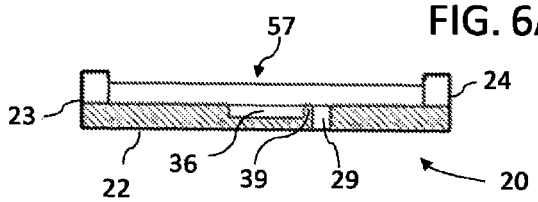
FIG. 6B
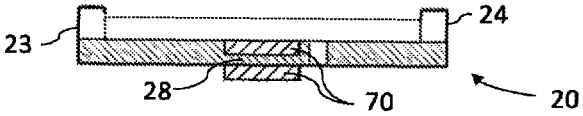
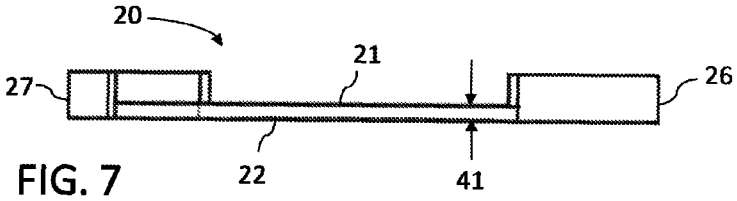
FIG. 7
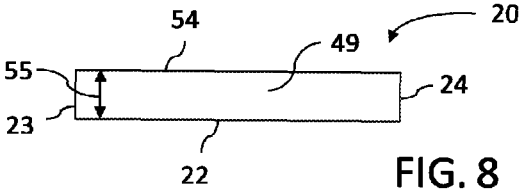
FIG. 8

FIG. 9
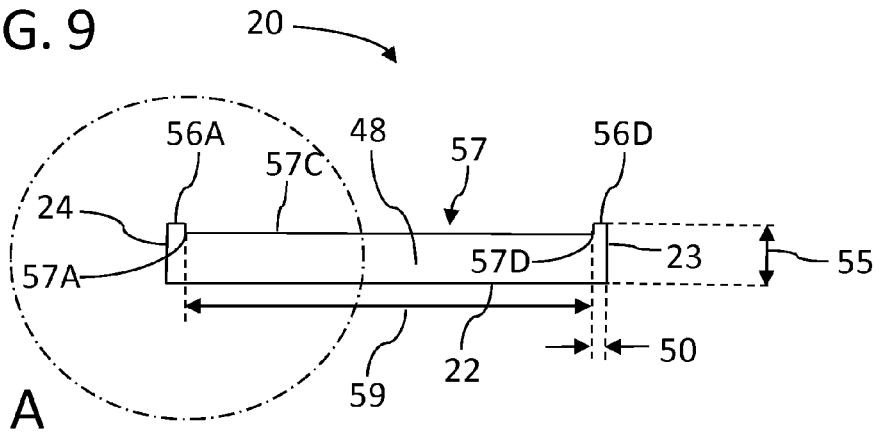
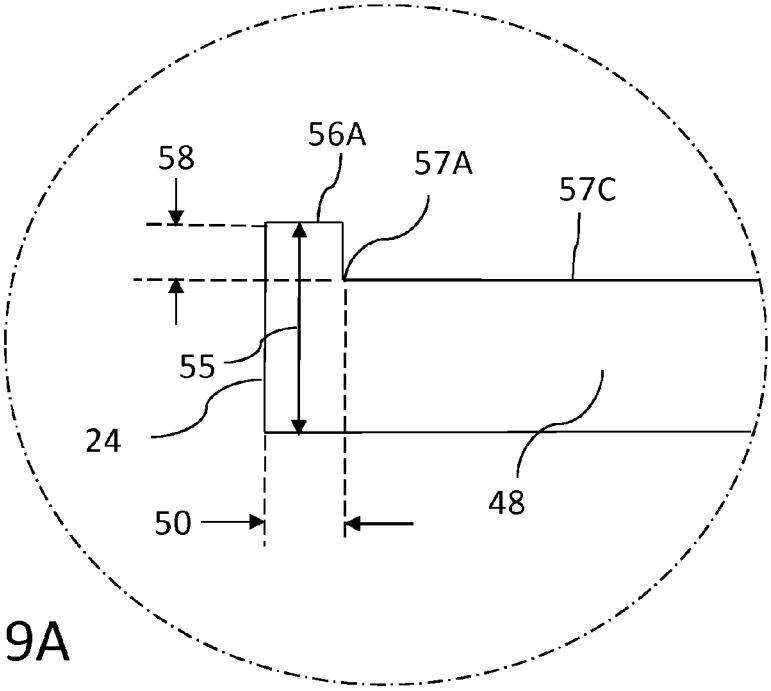
FIG. 9A

FIG. 10
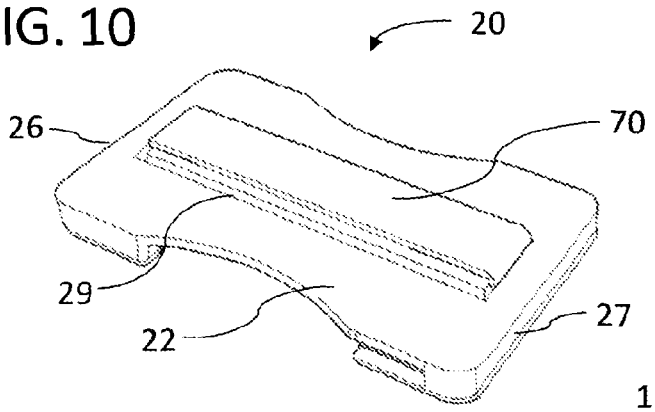
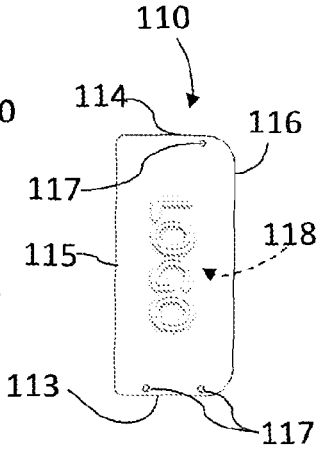
FIG. 13
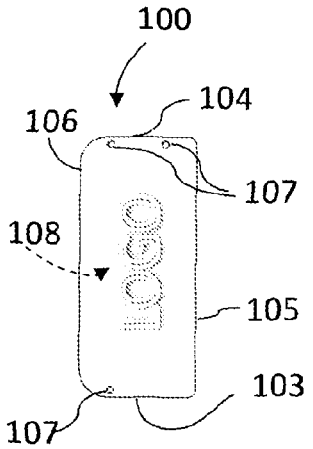
FIG. 12
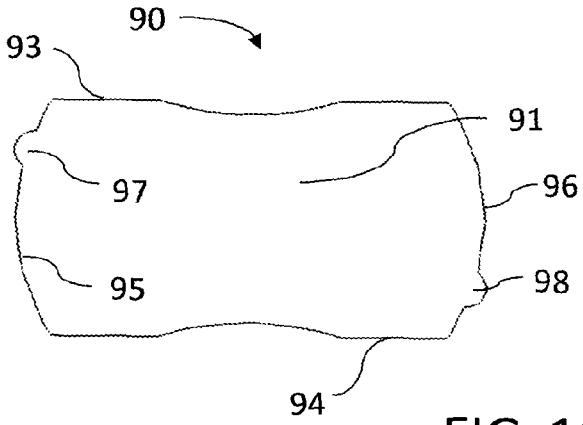
FIG. 11
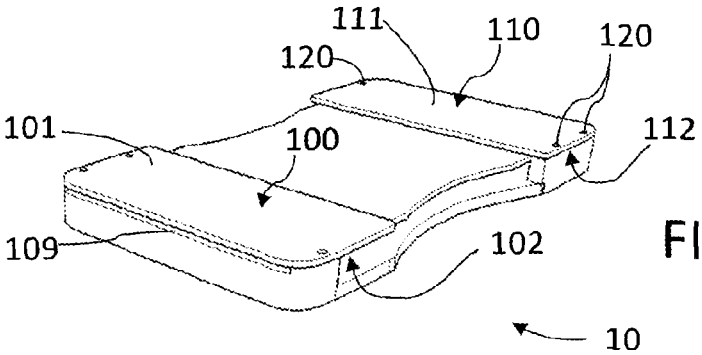
FIG. 14

COMPRESSION CARD HOLDER

FIELD OF THE INVENTION

The present invention relates generally to a pocket or purse organizer and, in particular, to a device for holding paper money and wallet sized cards, such as those containing credit or identification information.

BACKGROUND OF THE INVENTION

It is often desirable for individuals to maintain their paper money and cards (i.e., credit cards, debit cards, identification cards, smartcards, and the like) in a convenient location other than a traditional wallet or billfold. Oftentimes, individuals don't need a full-sized traditional wallet and would prefer a card and money holder which can conveniently hold a few cards and/or some bills.

Traditional wallets are usually placed in a purse or the rear pocket of pants or skirt. Sometimes, an individual may not want to carry a purse and/or carry a wallet in a rear pocket. In many instances, modern day fashions often incorporate close fitting pants or skirts, many without back pockets, which cannot accommodate a traditional wallet. Moreover, when carried in a rear pocket, traditional wallets are often visually apparent because of their bulk. In addition to being fashionably undesirable, they are susceptible to lifting by a pickpocket. In such cases, many individuals prefer to carry their paper money and cards in a front pocket in order to hide the money and cards. The front pocket is a location that makes lifting of its contents less likely. However, with paper money and several cards, the contents of a pocket may become quite disorganized. It would be convenient to have compact holder for cards and/or paper money which is simple and convenient to use.

The related art has recognized this need and includes a variety of card and money holding devices. Conventional practice is to employ a holder having a spring clip on one side for retaining a quantity of folded money, such as bills and the like, and on the opposite side a receptacle for holding a quantity of business cards and/or credit cards, see U.S. Pat. No. 5,358,019; U.S. Pat. No. 5,944,080; U.S. Pat. No. 6,412,627; and the references contained therein.

However, problems and difficulties have been encountered with such money clip and card holders which stem from the fact that the clip has a permanent bias which becomes weakened after use and, therefore, over time renders the clip unsuitable for holding folded bills. One of the difficulties with traditional card holders is that they require two hands to search through so as to eventually retrieve the desired card form the contained grouping. Card holders with a sliding drawer design, so that individual cards may be retrieved, may be bulky and have parts that may become lost or broken.

There continues to be a need in the art for a card and money holder that stores, protects, and allows easy retrieval of an individual card in a compactly-designed case, with no separate components to lose or break. Further, it would be advantageous if the card holder included a structure which functionality aided in the retention of a plurality of cards while facilitating their remove, one at a time.

SUMMARY OF THE INVENTION

The present invention of a card and money holder for releasably holding one or more rectangular cards comprising: (A) a generally rectangular shaped card and money holder having generally flat planar rectangular bottom and top, each of the top and bottom having a longest length dimension and a shorter width dimension, and four generally flat planar rectangular sidewalls that determine the card and money holder height dimension, the top, bottom and sidewalls of the card and money holder having generally flat inside surfaces that define a rectangular shaped card-holding space for one or more rectangular cards, wherein: (1) the top has an insertion aperture extending across its width centered at or near midpoint of the length dimension, which insertion aperture receives the width dimension of a rectangular card that is placed with its flat surface generally parallel to the card and money holder top but at a 90 angle thereto and (2) the length dimension sidewalls both have (a) edge apertures that allow a card to be received into and remain flat when it is received in the top surface aperture and (b) receiving apertures that permit the card to be rotated 90 degrees relative to the card and money holder and slide edgewise through the apertures and inserted into the interior of the card and money holder; (B) a compression plate inside the card and money holder, said compression plate having a flat upper surface that is generally parallel to and, when no cards are retained, adjacent to the flat inside surface of the card and money holder top and that provides compression against one or more flat inserted cards and presses the inserted cards in the card-holding space against the inside surface of the card and money holder top, the compression plate able to be decompressed away from the inside surface of the card and money holder top by human finger pressure when (i) a card is being received into the top surface aperture and rotated through the sidewall apertures into the card and money holder or (ii) a card is being removed from the card and money holder.

In another embodiment of the card and money holder described herein above, one or both of the width dimension sidewalls has a slit aperture that allows a retained card to be removed by decompression of the compression plate and sliding the card lengthwise out of the card and money holder through the slit aperture.

In another embodiment of the card and money holder described herein above, the bottom outside surface comprises an attached elastic retaining band wherein one or more card and/or folded paper money may be retained by the elastic retaining band against the outside surface of the card and money holder bottom.

A further embodiment of the present invention is a card and money holder for releasably holding one or more rectangular cards comprising: an essentially rectangular shaped base with a inside surface for retaining one or more card and an opposing substantially planar outside surface, said base comprising: (a) first and second opposed longitudinally extending side edges adjoined at corners with first and second opposed transversely extending end edges, the first end edge has a first sidewall and the second end edge has a second sidewall, wherein the sidewalls retain said card(s), each sidewall has an inside surface, an outside surface, a height, a top surface, and a bottom surface being the outside surface of the base, the first sidewall on the first end edge extends the full length of the end edge having a first end at a first side edge and a second end at the second side edge which extends around the corner to form a partial sidewall on the adjoining second side edge, the second sidewall on the second end edge extends the full length of the end edge having a first end at a second side edge and a second end at the first side edge which extends around the corner to form a partial sidewall on the adjoining first side edge, wherein the partially extended sidewalls are at corners positioned diagonally from one another and are spaced wide enough apart so as to be able to receive a card in the direction perpendicular to the side edges and allow for rotation of said perpendicularly oriented card 90 degrees into the base to have an orientation parallel to the side edges, optionally, one or both sidewalls comprise one or more compression plate alignment tab guide and (b) optionally, one or more recess for accepting a compression means, (ii) one or more compression means each having a first surface and a second surface wherein each said first surface is in contact with the base, (iii) a compression plate, said compression plate is essentially a flat, rigid rectangular plate having a top surface, a bottom surface, first and second opposed longitudinally extending side edges adjoined at corners with first and second opposed transversely extending end edges, and optionally one or more aligning tab guides on one or both end edges, the compression plate is elastically positioned within the sidewalls of the base and the bottom surface of the compression plate is in contact with the second surface of the one or more compression means, when sufficient pressure is applied to the top surface of the compression plate, the compression means compress and the compression plate move towards the base, when pressure is released, the compression means decompress and the compression plate moves away from the base, and (iv) two top plates, comprising: (a) a first top plate, said first top plate is essentially a flat, rigid rectangular plate having a top surface, a bottom surface, opposing first and second short side edges adjoined at corners with opposing first and second long end edges, wherein the bottom surface of the first top plate is connected to the top surface of the first sidewall and (b) a second top plate, which be identical to or different from the first top plate, said second top plate is essentially a flat, rigid rectangular plate having a top surface, a bottom surface, opposing first and second short side edges adjoined at corners with opposing first and second long end edges, wherein all mating edges and corners of the base and the top plates are flush. Preferably the second sidewall comprises a notch in its top surface wide and deep enough for a card to slide through in the direction parallel to the side edges wherein the bottom surface of the second top plate is connected to the top surface of the second sidewall, the bottom of the second top plate and the notch on the top surface of the second sidewall form a slot from which a card may be removed from the card and money holder. More preferably, the base (i) further comprises: (c) a longitudinal tab section, having a width and a first, second, and third edge, said tab section is essentially rectangular in shape and defines a U-shaped slot that extends through the base, said tab section comprises a groove, having a depth and width, extending the length of the tab section and a retaining lip, having a width, wherein the groove is on the inside surface of the base wherein said retaining lip is located between the edge formed by the U-shaped slot and the groove, the width of the groove is the width of the tab section minus the width of the retaining lip, said groove is wide and deep enough to accommodate an elastic retaining band, said retaining lip maintains the elastic retaining band in the groove and (d) an elastic retaining band formed in a continuous loop, said band is fitted through the U-shaped slot fitted into the grove of the tab section and held in place by the retaining lip so as to encircle the tab section such that part of the elastic retaining band is against the inside surface of the base and part of the elastic retaining band against the outside surface of the base wherein one or more card and/or folded paper money may be retained between the elastic retaining band and the outside surface of the base.

Another embodiment of the present invention is a card and money holder which is compact when filled with varying amounts of cards and money.

Another embodiment of the present invention is a card and money holder which can retain a plurality of cards equally as well as it can retain a single card.

Another embodiment of the present invention is a card and money holder which provides radio frequency identification (RFID) shielding for one or more smartcard retained therein.

Yet another embodiment of the present invention is a card and money holder which has no sharp edges that may snag and tear clothing.

BRIEF DESCRIPTION OF THE DRAWINGS

FIG. 5A is a first cross-sectional view of a base in accordance with the embodiments of the present invention.

FIG. 5B is a first cross-sectional view of a base comprising an elastic retaining band in accordance with the embodiments of the present invention.

FIG. 6A is a second cross-sectional view of a base in accordance with the embodiments of the present invention.

FIG. 6B is a second cross-sectional view of a base comprising an elastic retaining band in accordance with the embodiments of the present invention.

FIG. 7 is a first side plan view of a base in accordance with the embodiments of the present invention.

FIG. 8 is a first end plan view of a base in accordance with the embodiments of the present invention.

FIG. 9 is a second end plan view of a base in accordance with the embodiments of the present invention.

FIG. 9A is a magnification of a cut-away section A of a second end plan view of a base in accordance with the embodiments of the present invention.

FIG. 10 is a perspective bottom view of a card and money holder in accordance with the embodiments of the present invention.

FIG. 11 is a plan view of a compression plate in accordance with the embodiments of the present invention.

FIG. 12 is a plan view of a first top plate in accordance with the embodiments of the present invention.

FIG. 13 is a plan view of a second top plate in accordance with the embodiments of the present invention.

FIG. 14 is a perspective top view of a card and money holder in accordance with the embodiments of the present invention.

DETAILED DESCRIPTION OF THE INVENTION

Figure 1A:
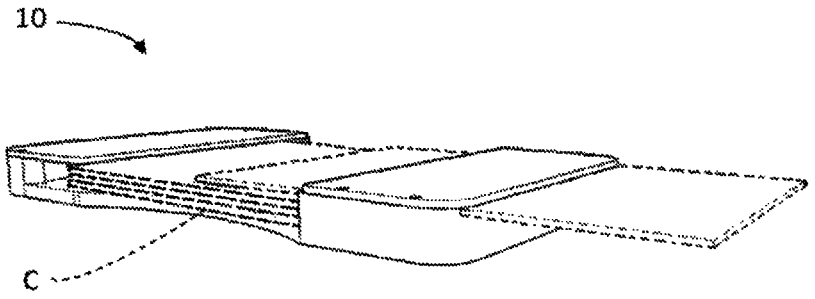
FIG. 1A is a perspective top view of a card and money holder in accordance with the embodiments of the present invention, with a plurality of cards shown in phantom lines.

The principal object of the present invention is to provide a holder for cards and/or paper money which is simple and convenient to use. Preferably, the card and money holder of the present invention can accommodate various quantities of cards and folded paper currency, will provide many years of maintenance-free use, is small and compact and can easily fit into a front pocket without any noticeable bulge, has no sharp protruding edges and will not snag or tear clothing, allows for the insertion and extraction of either cards or money easily and without disturbing the other, and may provide RFID shielding for smartcards retained therein.

As used herein, the term "rectangular cards" or "cards" is meant to include any card typically carried in a wallet or billfold, such as license, credit, fuel, check, ATM, and membership cards, that are approximately 8.5 cm long by 5.5 cm wide and a thickness of 1 mm or less. Of course, as would be obvious to one skilled in the art, the case of the present invention may be made to dimensions that are suitable for carrying various numbers of cards as well as cards of other dimensions, for example, business cards. The present invention may also utilize accessory cards adapted to provide general utility functions, such a reflective surface, a magnifying glass, displaying a photograph, holding a nail file, spare key, or the like.

In the broadest sense, the card and money holder of the present invention is a card and money holder for releasably holding one or more rectangular cards comprising (A) a generally rectangular prism shaped card and money holder, herein after referred to as "rectangular shaped card and money holder" and (B) a compression plate inside the rectangular shaped card and money holder.

The generally rectangular shaped card and money holder has a generally flat planar rectangular bottom and top, each of the top and bottom having a longest length dimension and a shorter width dimension, and four generally flat planar rectangular sidewalls that determine the card and money holder height dimension, the top, bottom and sidewalls of the card and money holder having generally flat inside surfaces that define a rectangular shaped card-holding space for one or more rectangular cards. The edges and/or corners formed between the top, bottom, and sidewalls may be sharp, rounded, or a combination thereof.

The top of the card and money holder has an insertion aperture extending across its width centered at or near midpoint of the length dimension, which insertion aperture receives the width dimension of a rectangular card that is placed with its flat surface generally parallel to the card and money holder top but at a 90 degree angle thereto.

The length dimension sidewalls both have (a) edge apertures that allow a card to be received into and remain flat when it is received in the top surface aperture and (b) receiving apertures that permit the card to be rotated 90 degrees relative to the card and money holder and slide edgewise through the receiving apertures and inserted into the interior of the card and money holder and retained therein by the edge apertures.

Said compression plate inside the card and money holder, has a flat upper surface that is generally parallel to and, when no cards are retained, adjacent to the flat inside surface of the card and money holder top. The compression plate provides compression against one or more flat inserted cards and presses the inserted cards in the card-holding space against the inside surface of the card and money holder top. The compression plate can be decompressed away from the inside surface of the card and money holder top, for example by human finger pressure, when a card is being received into the top surface aperture and rotated through the sidewall apertures into the card and money holder or when a card is being removed from the card and money holder.

In one embodiment of the present invention, one or both of the width dimension sidewalls of the rectangular shaped card and money holder has a slit aperture that allows a retained card to be removed by decompression of the compression plate and sliding the card lengthwise out of the card and money holder through the slit aperture.

In another embodiment of the present invention, the bottom outside surface of the rectangular shaped card and money holder comprises an attached elastic retaining band wherein one or more cards and/or folded paper money may be retained by the elastic retaining band against the outside surface of the card and money holder bottom.

Figure 1B:
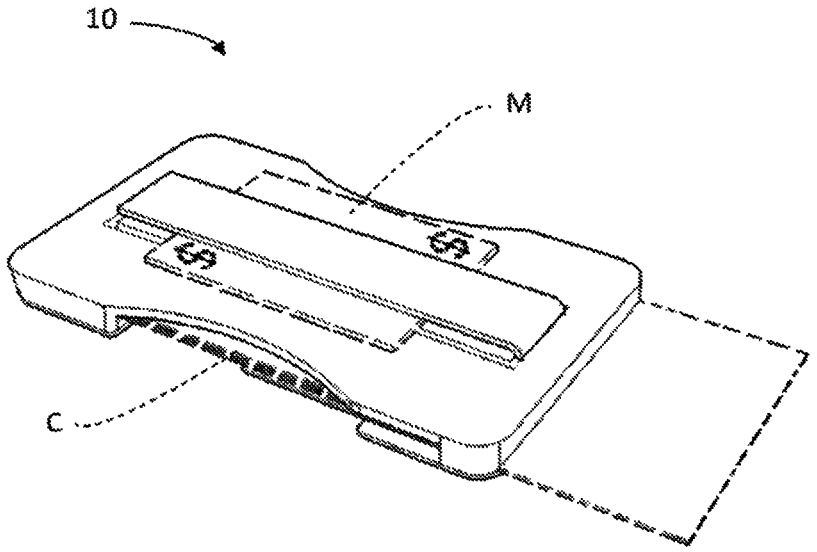
FIG. 1B is a perspective bottom view of a card and money holder in accordance with the embodiments of the present invention, with a plurality of cards and paper money shown in phantom lines.
Figure 2:
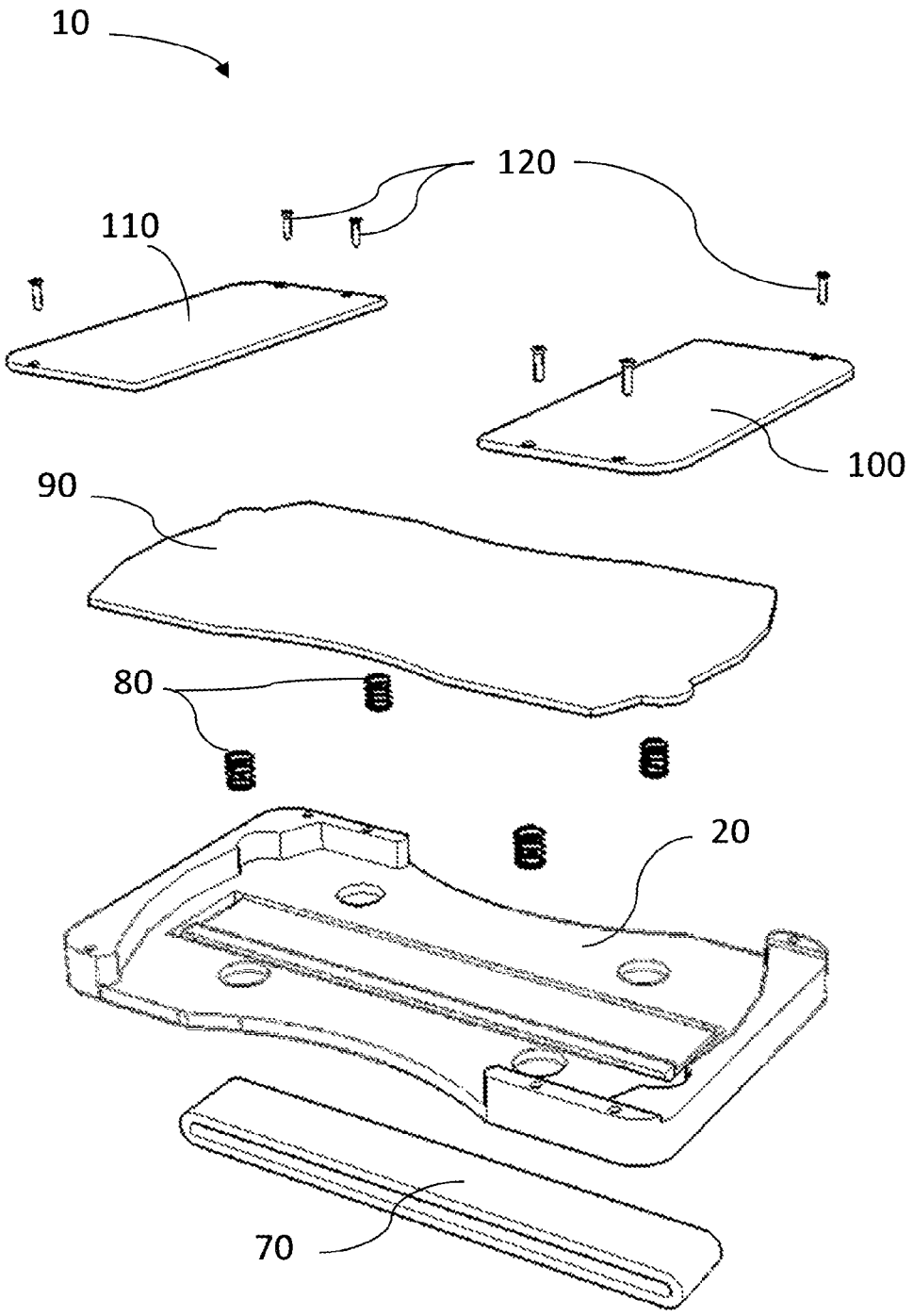
FIG. 2 is an exploded perspective view showing the various components in accordance with the embodiments of the card and money holder of the present invention.

An exemplary embodiment of the present invention is illustrated in perspective in FIG. 1A, FIG. 1B, and FIG. 2. The card and money holder 10 comprises a base 20 comprising any material that can be milled, cast, carved, or molded into the desirable shape. Suitable base materials include, but are not limited to, wood; glass; ceramic; metal, for instance aluminum, stainless steel, titanium, and the like; more preferably the material is a plastic material, such as a thermoset polymer such as an epoxy polymer or a rigid polyurethane, or even more preferably a thermoplastic polymer. Suitable thermoplastics include, but are not limited to, polycarbonate (PC); acrylonitrile, butadiene, styrene terpolymers (ABS); blends of PC/ABS, polyacrylates, filled or non-filled thermoplastic olefins (TPOs), and the like. In one embodiment, the thermoplastic polymer may comprise a conductive material, such as metal fibers, metal coated fibers, or metal flake to provide radio frequency interference (RFI) shielding. The thermoplastic polymer may be colorless (clear), black, white, or any desired color, it may be transparent, translucent, or opaque. For stylistic considerations, the base may have sharp corners and/or edges, preferably the edges and/or corners of the base are rounded.

The dimensions of the base are selected to accommodate typical cards which are approximately 8.5 cm long by 5.5 cm wide and having a thickness of 1 mm or less.

The height of the base will determine the number of cards that the card and money holder can hold. The card and money holder of the present invention holds at least one card, preferably it can hold from 1 to 10 cards, more preferably from 1 to 7 cards, and most preferably from 1 to 4 cards.

The card and money holder 10 further comprises two top plates 100 and 110 and a compression plate 90 which is elastically positioned between the base and the top plates. The top plates and compression plate are fabricated from a generally flat sheet of rigid material. The compression plate and the top plates may comprise the same material or independently comprise different material; preferably they are made from the same material. Suitable materials from which to choose to make the compression plate and/or top plates are, but not limited to, wood; glass; ceramic; carbon fiber; plastic materials as described herein above; and preferably metal, for instance aluminum, stainless steel, brass, titanium, and the like. The compression plate and top plates may be naturally colored (e.g., the color of the material from which they are made) or colored as desired, and depending on the material from which they are made, they may be transparent, translucent, or opaque. One or both surfaces of the compression plate and top plates may be smooth or textured as desired.

Metal, such as aluminum, stainless steel, titanium, and the like, is the preferred material of choice for the compression plate and top plates. From an aesthetics view point, metal is considered stylish and affords a rich appearance. From a performance stand point, metal affords the strength and stiffness needed so as to remain flat and not bend during use.

Furthermore, a card and money holder of the present invention comprising a compression plate and top plates made of metal may provide electromagnetic shielding for radio frequency RFID (radio frequency identification) smartcards and/or contactless smartcards. Such shielding can be used to prevent wireless communications with the smartcards, such as in order to prevent unauthorized wireless access to data stored on the smartcards including, but not limited to, credit cards, security identification cards, ATM cards, and payment cards, such as those used for public transit, public phones, and electronic toll collection, among others.

Preferably, the compression plate and top plates are contoured to match in a flush manner with the base, in other words if the base has sharp corners and edges so well the longer edges of the compression plate and edges and corners of the top plates; however, preferably the edges and corners of the base, compression plate, and top plates are rounded.

In one embodiment, one or both top plates of the card and money holder of the present invention may comprise a unique and/or artistic design such as a message, picture, logo, or the like applied by any suitable means, such as imprinting, embossing, engraving, etc.

The top plates may be permanently or reversibly attached to the base by any suitable attachment means, such as snap fits, adhesives, heat staked, rivets, welds, and the like. Preferably the top plates are attached to the base by screws.

Cards are retained securely in place within the card and money holder of the present invention by sidewalls of the base and compressive force against one or more inserted cards pressing the inserted cards in the card-holding space against the inside surface of the top plates. The positive pressure is provided by a compression means between the base and the compression plate such that the compression means may be compressed when pushed upon but will return to its original shape when the pressure is released, for example an elastic-compressive material such as a foam, preferably a spring, for example, but not limited to compression springs, torsion springs, leaf springs, flat springs, and the like. Preferably the compression means is one or more compression spring, more preferably a coiled metal spring. There may be one or more compression means in the card and money holder of the present invention, preferably 2, more preferably 3, more preferably 4, more preferably 5, more preferably 6, up to and including as many as 20 compression means. The compressive means has a first surface or end that contacts the base and a second surface or end that contacts the compression plate.

In one embodiment of the card and money holder of the present invention, there are alignment means (one for each compression means) in the base to align and help retain the compression means, for example a recession within which a compression means such as a spring fits into, preferably, when sufficient pressure is applied to the compression plate to press it against the base, each spring is fully compressed and contained within its respective recession.

Optionally, the card and money holder of the present invention has an elastic retaining band for securing folded money and/or additional cards that are not retained within the card holding space of the card and money holder.

The manner of using the card and money holder of the present invention is relatively simple requiring a simple press and twist to insert the card and a sliding motion to remove. Additional cards and/or money, such as folded bills, can be retained between the base of the card and money holder and the elastic retaining band.

Referring now to the drawings, specific details are set forth in order to provide a more thorough understanding of the present invention. However, this is only one embodiment of the present invention and the invention may be practiced without these specific particulars. Accordingly, the specification and drawings are to be regarded in an illustrative, rather than a restrictive, sense.

A card and money holder 10 according to one embodiment of the present invention is shown holding a plurality of cards C and money M in FIG. 1A and FIG. 1B. Referring now to FIG. 2, the card and money holder 10 comprises a base 20, an optional elastic retaining band 70, a compression plate 90 and two top plates 100, 110, each of which are in contact with, and held in engagement to, the base 20 by screws 120. Compression coil springs 80 are intra-connectedly disposed between the compression plate 90 and the base 20.

Figure 3A:
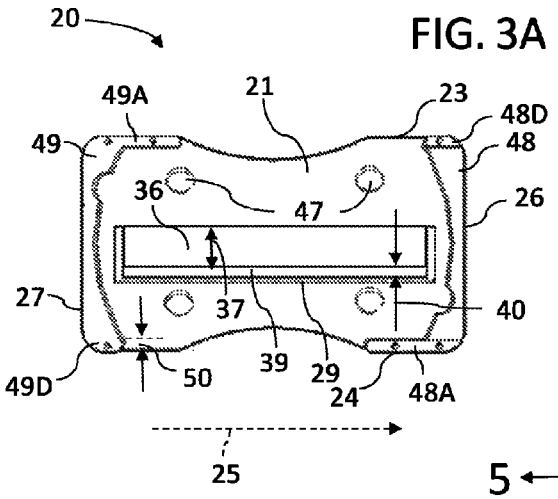
FIG. 3A is a top plan view of a base in accordance with the embodiments of the present invention.
Figure 3B:
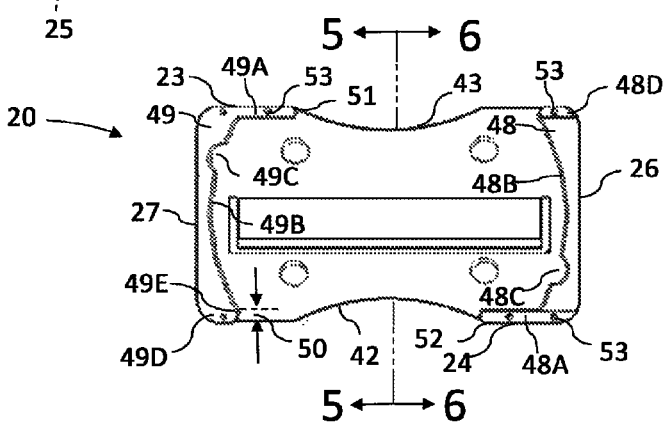
FIG. 3B is another top plan view of a base in accordance with the embodiments of the present invention.
Figure 4:
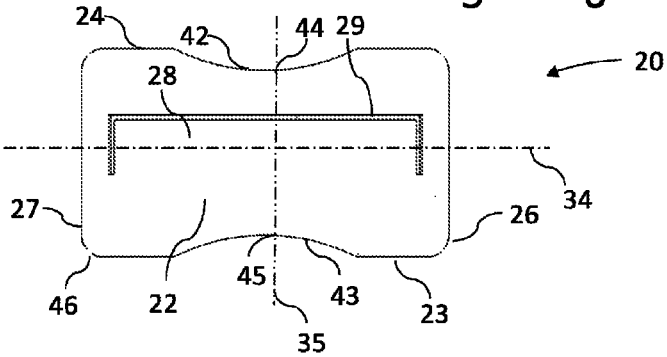
FIG. 4 is a bottom plan view of a base in accordance with the embodiments of the present invention.

Referring to FIG. 3A, FIG. 3B, and FIG. 4, the base 20 is essentially rectangular in shape having a first inside surface 21 for supporting and retaining cards and an opposing second substantially planar outside surface 22, optionally for supporting money and/or additional cards. Base 20 has first and second opposed longitudinally extending side edges (longest length dimensions), 23, 24, adjoining first and second transversely extending end edges, 26, 27, at corners 46. The first and second opposed longitudinally extending side edges, 23, 24, extend parallel to each other in a first direction 25 and the adjoining first and second transversely extending end edges (shorter width dimensions), 26, 27, are parallel to each other and perpendicular to the first and second opposed longitudinally extending side edges, 23, 24. The width of the base 20 is the distance from side edge 23 to side edge 24 and the length of the base 20 is the distance from end edge 26 to end edge 27.

The base 20 has sidewalls 48, 49, which extend the full length of end edges, 26 and 27, respectively. Sidewall 48 has a first end which is a leg 48A, having a thickness 50, extending partially along the side edge 24 and a second end 48D, having a thickness of 50, extending to side edge 23. Side wall 49 has a first end which is a leg 49A, having thickness 50, extending partially along the side edge 23 and a second end 49D, extending to side edge 24. Partially extended sidewalls 48A and 49A are at corners positioned diagonally from one another and act as retaining walls for cards held within the card and money holder 10. Preferably, the base 20 comprising sidewalls 48 and 49 is a one piece unit. In one embodiment, the base 20 comprising features, such as the U-shaped slot, 29, and/or recessions 47, is made by milling or injection molding. Alternatively, a blank base (not shown in the drawings) not having said features may be milled or injection molded and additional feature, for example, the U-shaped slot, 29, and/or recessions 47, may, if desired, added subsequently. Preferably, the base 20 is injection molded so as to comprise features such as U-shaped slot, 29, and/or recessions 47.

Leg 48A extends partially along the side edge 24 to a point 52 where the arc 42 intersects the side edge 24.

Optionally, side edges 23 and 24 have a curved section in the shape of an arc 42, 43 having their apex, 44, 45, respectively at the perpendicular centerline 35 of the base 20. Leg 49A extends partially along the side edge 23 to a point 51 where the arc 43 intersects the side edge 23. The distance in the longitudinal direction 25 between 51 and 52 (e.g., the insertion aperture) is at least the width of a card, typically equal to or greater than 5.5 cm. Sidewall 48 has an outside surface along end edge 26 and part of side edge 24, and an inside surface 48B. Sidewall 49 has an outside surface along end edge 27 and part of side edge 23, and an inside surface 49B. Sidewall 49 has an inside surface 49B which does not have to be, but preferably is in the shape of an arc, wherein the thickness of the sidewall 49 at the centerline 34 is the thinnest section of the sidewall 49. The arc for the inside surface 49B continues from a distance 50 from end edge 24 at 49E to the inside surface of 49A (which is also has a thickness of 50). Sidewall 48 has an inside surface 48B which does not have to be, but preferably is in the shape of an arc having the same radius as the arc of 49B, wherein the thickness of the sidewall 48 at the centerline 34 is the thinnest section of the sidewall 48. The arc for the inside surface 48B continues up to a section 48D along side edge 23 having a thickness of 50 and to the inside surface of 48A (which is also has a thickness of 50). Preferably, the radius for the arc of the inside surface 48B is equal to the radius of the arc on the inside surface 49B and the radius is at least large enough to allow for a card to rotate into the card and money holder 10.

Optionally, one or both sidewalls 48, 49 of the base 20 comprise one or more compression plate alignment tab guide 48C, 49C and the compression plate 90 comprises one or more alignment tab 97, 98 on each end 95, 96, FIG. 11. As shown in FIG. 3, sidewalls 48 and 49 each comprise a compression plate alignment tab guide 48C and 49C, respectively, on their inside surfaces 48B and 49B, respectively. The compression plate alignment tab guides 48C and 49C locate and retain the compression plate 90 within the body of the card and money holder 10.

One or more receptors 53, such as holes, to accept screws 120, are located in sidewalls 48 and 49.

The base 20 contains an essentially rectangular longitudinal tab section 28 having a first, second, and third edge defining a U-shaped slot 29 said slot extends entirely through the base 20, wherein its corners may be square or rounded. The U-shaped slot 29 has a width, 30 and the tab section 28 has length, 31, in the longitudinal direction. Preferably, the tab section 28 is centered on the base 20, as shown in FIG. 4, the centerline 34 of the base 20 which is parallel to the first direction 25 bisects the U-shaped slot 29. The centerline 35 of the base 20 perpendicular the first direction 25 bisects the tab section 28.

The tab section 28 has a groove 36 on the inside surface of the base 21 for receiving the elastic retaining band 50 which is a continuous elastic loop. The groove 36 extends the full length of the tab section 28. The groove 36 has a width 37 wide enough to accommodate the elastic retaining band 70 and a depth 38 wherein the depth 38 of the groove 36 in the tab section 28 is less than the thickness of the nominal thickness 41 of the base 20, FIG. 5A, FIG. 6A, and FIG. 7. Preferably, the groove 36 is deep enough so that when the elastic retaining band 70 is positioned in the groove 36 the elastic retaining band 70 does not extend above the inside surface 21 of the base 20, FIG. 5B, and FIG. 6B. There is a retaining lip 39 for holding the elastic retaining band 70 in place, along the second edge of the tab section 28 with one side formed by the groove 36 and the other side formed by the edge of the longer longitudinally extending slot 29, the retaining lip has a width 40, preferably the retaining lip 39 extends the full length of the tab section 28 as shown in FIG. 3A and FIG. 3B. The thickness of the retaining lip 39 is the nominal thickness 41 of the base 20.

Referring to FIG. 8, sidewall 49 has a top surface 54 and a height 55 from the outside surface of the base 22 to the top surface 54. Referring to FIG. 9 and FIG. 9A, leg 48A and end 48D of sidewall 48 have top surfaces 56A and 56D, respectively, both having the same height 55. Sidewall 48 comprises a notch 57 having a depth 58, a width 59, a top surface 57C, and ends 57A and 57D extending transversely across side wall 48. The distance from the notch end 57A to the side edge 24 is 50 and the distance from the notch end 57D to the side edge 23 is 50, which corresponds to the inside surface of leg 48A and end 48D, respectively. The notch 57 is wide and deep enough to accommodate the width and thickness of a card.

Referring to FIG. 5B, FIG. 6B, and FIG. 10, the elastic retaining band 70 formed in the shape of a continuous loop is fitted through the U-shaped slot 29, into grove 36 of the tab section 28 so as to encircle the tab section 28 with part of the elastic retaining band 70 on the inside 21 of the base 20 and part of the elastic retaining band 70 on the outside 22 of the base 20. The elastic retaining band 70 may be used to hold cards, paper money, a coin, a key, or the like.

Preferably, the corners 46 of the base 20 are rounded, each having a radius. Four recessions 47 are formed on the inside of the base 21 and are configured to receive the coil springs 80.

Each spring 80 has a first end 81 and a second end 82. The first end 81 of a spring is located in recessions 47 and in contact with the base 20. The recession 47 is deep enough so that when a spring 80 is fully compressed, the second end 82 is flush with the inside surface 21 of the base 20.

Referring to FIG. 11, the compression plate 90 is essentially a flat, rigid rectangular plate having a top side 91, a bottom side 92, a first longitudinally extending side edge 93, a second longitudinally extending side edge 94, a first transversely extending end edge 95, a second transversely extending end edge 96, a first aligning tab 97, and a second aligning tab 98. Preferably, the contour of side edges 93 and 94 match the contour of side edges 23 and 24 of the base 20. The contour of end edges 95 and 96 match the contour of inside surfaces of the sidewalls 48 and 49 of the base 20. The contour of edges 95 and 96 matches arc of the inside side surfaces 48B and 49B of sidewalls 48 and 49, respectively. The compression plate 90 fits within the sidewalls 48, 49 of the base 20 with its bottom side 92 facing the base inside surface 21. The bottom side 92 is in contact with the second end 82 of each of the four springs 80 with alignment tabs 97 and 98 fit within the alignment tab guides 49C and 48C, respectively, and edge 93 near the inside surface of leg 49A and edge 94 near the inside surface of the leg 48A. When the compression plate 90 is fully compressed (e.g., by applying sufficient pressure) the springs 80 compress, with enough force, the bottom surface 92 of the compression plate 90 may fully contact the inside surface 21 of the base 20 because the elastic retaining band 70 and the second springs ends 82 are flush with the inside surface 21 (the springs are compressed within recesses 47). When pressure is released, the compression means 80 decompress and the compression plate 90 moves away from the base 20. When the compression plate 90 is fully compressed, the edges 93 and 94 are essentially flush with edges 23 and 24.

Referring to FIG. 12, FIG. 13, and FIG. 14, a first top plate 100 and a second top place 110 are shown. The first top plate 100 may be the different from the second top plate 110, preferably the first and second top plates are the same. Each top plate 100, 110, has a top surface 101, 111, a bottom surface 102, 112, a first short side, 103, 113, a second short side, 104, 114, a first long side 105, 115, and a second long side, 106, 116. Each top plate 100, 110, has three holes 107, 117, through which screws 120 pass to join each top plate 100, 110, to the base 120. Preferably, the corners of top plate 100 between sides 103 and 106 and sides 104 and 106 have a radius which is preferably the same as the radius on the corners 46 of the base 120. Preferably, the corners of top plate 100 between sides 103 and 105 and sides 104 and 105 have enough of a radius so that the corners are not sharp. Preferably, the corners of top plate 110 between sides 113 and 116 and sides 114 and 116 have a radius which is the same as the radius on the corners 46 of the base 120. The corners of top plate 110 between sides 113 and 115 and sides 114 and 115 have enough of a radius so that the corners are not sharp. Optionally, one or both top plates, 100, 110, may have located on the top surface 101, 111, a design, such as a logo 108, 118, the design may be the same or different for each top plate.

Referring to FIG. 14, each of top plates 100 and 110 are held in engagement to the base 20 (comprising the elastic retaining band 70, springs 80, located in recessions 47, which are in contact with the compression plate 90) by three screws 120 by engaging the base at receptors 53 such the bottom surface 102 of top plate 100 contacts the top surface of sidewall 49 and the bottom surface 112 for top plate 110 contacts the top surface of sidewall 48. When there is no pressure on compression plate 90, e.g., the springs 80 are fully extended, the top side 91 of the compression plate 90, when (1) there are no cards in the holder, contacts the bottom side 102 surface of top plate 100 and bottom side 112 surface of top plate 110 or (2) there are one or more card in the holder the card(s) are sandwiched between the compression plate 90 and the top plates 100, 110. When the top plate 100 is attached to the base 120, preferably the sides 103, 106, 104, of the top plate 100 are flush with the sides 23, 26, 24, of the base 120, respectively. When the top plate 110 is attached to the base 120, preferably the sides 113, 116, 114, of the top plate 110 are flush with the sides 24, 27, 23, of the base 120, respectively.

When the bottom surface 102 of top plate 100 is affixed to the top surface 56A and 56D of sidewall 48, the bottom surface 102 of the top plate 100 and the top surface 57C of the notch form a slot 109 from which a card can be removed from the card and money holder 10. The depth 58 of the notch 57, from the top surface 56A and 56D of sidewall 48 to the top surface of the notch 57C is, at minimum, a distance large enough to allow removal of a card from the card and money holder 10.

Figure 15:
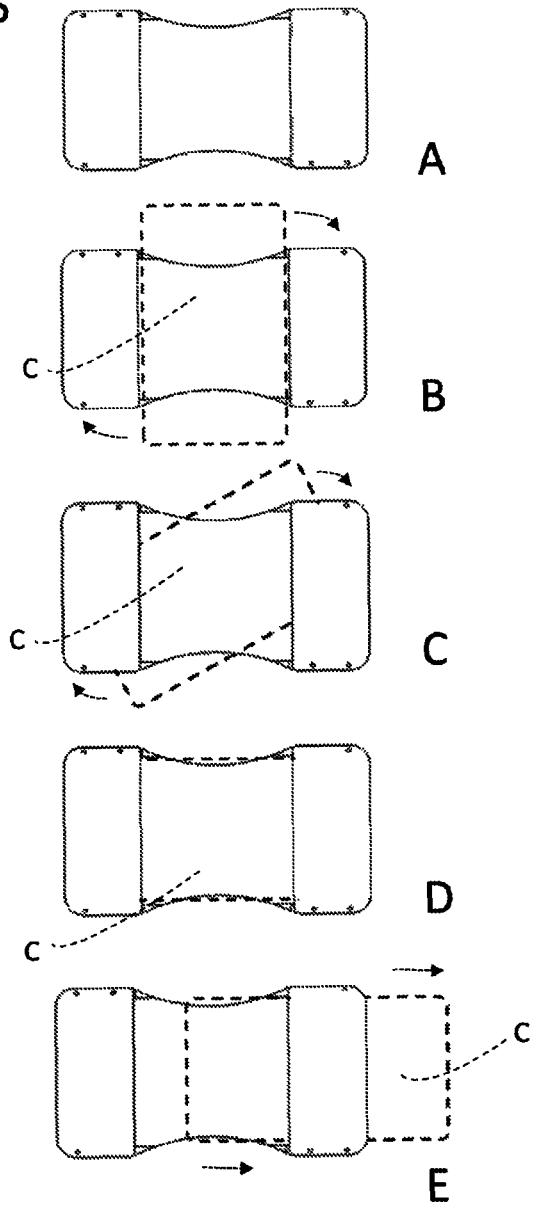
FIG. 15 illustrates a plan top view of a card and money holder A, sequence of steps for card insertion into a card and money holder B-D, and card removal E from a card and money holder in accordance with the embodiments of the present invention.

Now referring to FIG. 15, the manner of using the card and money holder of the present invention A is relatively simple. To insert a card C into the card and money holder, position the card C perpendicular to the card and money holder B, while pushing the card C down on the compression plate, rotate the card C 90 degrees clockwise until the card C is held securely in place by sidewalls of the base B to D, then remove pressure from the card C. The card C is then securely held in the card and money holder. Removal of a card C from the card and money holder may be accomplished by using one or two hands. To remove a card C from the card and money holder, hold the card and money holder by the sides, apply pressure to the top card C with a thumb or finger(s) and slide it lengthwise out the slot on the end of the card and money holder, then grasp the card C and remove it E.

While only one particular and preferred embodiment is described, it should now be apparent to those skilled in the art, how alternative embodiments may implement the purposes of the present invention. As such, the invention can only be construed and limited in its breadth by the scope of the claims that follow.

What is claimed is:

1. A card and money holder for releasably holding one or more rectangular cards comprising:

A a generally rectangular shaped card and money holder having generally flat planar rectangular bottom and top, each of the top and bottom having a longest length dimension and a shorter width dimension, and four generally flat planar rectangular sidewalls that determine the card and money holder height dimension, the top, bottom and sidewalls of the card and money holder having generally flat inside surfaces that define a rectangular shaped card-holding space for one or more rectangular cards, wherein:

(1) the top has an insertion aperture extending across its width centered at or near midpoint of the length dimension, which insertion aperture receives the width dimension of a rectangular card that is placed with its flat surface generally parallel to the card and money holder top but at a 90 angle thereto and (2) the length dimension sidewalls both have (a) edge apertures that allow a card to be received into and remain flat when it is received in the top surface aperture and (b) receiving apertures that permit the card to be rotated 90 degrees relative to the card and money holder and slide edgewise through the apertures and inserted into the interior of the card and money holder;

B a compression plate inside the card and money holder, said compression plate having a flat upper surface that is generally parallel to and, when no cards are retained, adjacent to the flat inside surface of the card and money holder top and that provides compression against one or more flat inserted cards and presses the inserted cards in the card-holding space against the inside surface of the card and money holder top, the compression plate able to be decompressed away from the inside surface of the card and money holder top by human finger pressure when (i) a card is being received into the top surface aperture and rotated through the sidewall apertures into the card and money holder or (ii) a card is being removed from the card and money holder.

2. The card and money holder of claim 1 wherein one or both of the width dimension sidewalls has a slit aperture that allows a retained card to be removed by decompression of the compression plate and sliding the card lengthwise out of the card and money holder through the slit aperture.

3. The card and money holder of claim 1 wherein the bottom outside surface comprises an attached elastic retaining band wherein one or more card and/or folded paper money may be retained by the elastic retaining band against the outside surface of the card and money holder bottom.

4. The card and money holder of claim 2 wherein the bottom outside surface comprises an attached elastic retaining band wherein one or more card and/or folded paper money may be retained by the elastic retaining band against the outside surface of the card and money holder bottom.

5. A card and money holder for releasably holding one or more rectangular cards comprising:

(i) a rectangular shaped base with an inside surface for retaining one or more card and an opposing substantially planar outside surface, said base comprising:

(a) first and second opposed longitudinally extending side edges adjoined at corners with first and second opposed transversely extending end edges, the first end edge has a first sidewall and the second end edge has a second sidewall, wherein the sidewalls retain said card(s), each sidewall has an inside surface, an outside surface, a height, a top surface, and a bottom surface being the outside surface of the base, the first sidewall on the first end edge extends the full length of the end edge having a first end at a first side edge and a second end at the second side edge which extends around the corner to form a partial sidewall on the adjoining second side edge, the second sidewall on the second end edge extends the full length of the end edge having a first end at a second side edge and a second end at the first side edge which extends around the corner to form a partial sidewall on the adjoining first side edge, wherein the partially extended sidewalls are at corners positioned diagonally from one another and are spaced wide enough apart so as to be able to receive a card in the direction perpendicular to the side edges and allow for rotation of said perpendicularly oriented card 90 degrees into the base to have an orientation parallel to the side edges, wherein, one or both sidewalls comprise one or more compression plate alignment tab guide and (b) wherein, one or more recess for accepting a compression means, (ii) one or more compression means each having a first surface and a second surface wherein each said first surface is in contact with the base, (iii) a compression plate, said compression plate is essentially a flat, rigid rectangular plate having a top surface, a bottom surface, first and second opposed longitudinally extending side edges adjoined at corners with first and second opposed transversely extending end edges, and optionally one or more aligning tab guides on one or both end edges, the compression plate is elastically positioned within the sidewalls of the base and the bottom surface of the compression plate is in contact with the second surface of the one or more compression means, when sufficient pressure is applied to the top surface of the compression plate, the compression means compress and the compression plate move towards the base, when pressure is released, the compression means decompress and the compression plate moves away from the base, and (iv) two top plates, comprising:

(a) a first top plate, said first top plate is essentially a flat, rigid rectangular plate having a top surface, a bottom surface, opposing first and second short side edges adjoined at corners with opposing first and second long end edges, wherein the bottom surface of the first top plate is connected to the top surface of the first sidewall and (b) a second top plate, which be identical to or different from the first top plate, said second top plate is essentially a flat, rigid rectangular plate having a top surface, a bottom surface, opposing first and second short side edges adjoined at corners with opposing first and second long end edges, wherein all mating edges and corners of the base and the top plates are flush.

6. The card and money holder of claim 5 wherein the second sidewall comprises a notch in its top surface wide and deep enough for a card to slide through in the direction parallel to the side edges wherein the bottom surface of the second top plate is connected to the top surface of the second sidewall, the bottom of the second top plate and the notch on the top surface of the second sidewall form a slot from which a card may be removed from the card and money holder.

7. The card and money holder of claim 5 wherein the base (i) further comprises:

(c) a longitudinal tab section, having a width and a first, second, and third edge, said tab section is essentially rectangular in shape and defines a U-shaped slot that extends through the base, said tab section comprises a groove, having a depth and width, extending the length of the tab section and a retaining lip, having a width, wherein the groove is on the inside surface of the base wherein said retaining lip is located between the edge formed by the U-shaped slot and the groove, the width of the groove is the width of the tab section minus the width of the retaining lip, said groove is wide and deep enough to accommodate an elastic retaining band, said retaining lip maintains the elastic retaining band in the groove and (d) an elastic retaining band formed in a continuous loop, said band is fitted through the U-shaped slot fitted into the grove of the tab section and held in place by the retaining lip so as to encircle the tab section such that part of the elastic retaining band is against the inside surface of the base and part of the elastic retaining band against the outside surface of the base wherein one or more card and/or folded paper money may be retained between the elastic retaining band and the outside surface of the base.

8. The card and money holder of claim 1 which provides radio frequency identification (RFID) shielding for one or more smartcard retained therein.

9. The card and money holder of claim 5 which provides radio frequency identification (RFID) shielding for one or more smartcard retained therein.

10. The card and money holder of claim 5 wherein the compression means is chosen from a group of one or more of compression springs, torsion springs, leaf springs, flat springs, and the like.

* * * * *